United States Patent [19]

Williamson et al.

[11] 4,417,351

[45] Nov. 22, 1983

[54] STACKED ARTICLE COUNTING APPARATUS

[75] Inventors: Harry L. Williamson, Franklin, Ky.; Robert A. West, Portland; Richard P. Manning, Nashville, both of Tenn.

[73] Assignee: Intercontinental Data Corporation, Portland, Tenn.

[21] Appl. No.: 272,553

[22] Filed: Jun. 3, 1981

[51] Int. Cl.[3] ..... G06M 9/00

[52] U.S. Cl. ..... 377/8; 414/901; 33/143 L

[58] Field of Search ..... 377/8; 271/215, 217; 364/471, 478, 562; 414/900, 901; 340/674; 33/143 R, 143 L

[56] References Cited

U.S. PATENT DOCUMENTS

| | | | |
|---|---|---|---|
| 2,799,939 | 7/1957 | Bivans | 33/143 R |
| 3,118,232 | 1/1964 | Hartsock | 33/143 R |
| 3,298,605 | 1/1967 | Bucke et al. | 33/143 L |
| 3,808,692 | 5/1974 | Gartner | 33/143 R |
| 3,834,031 | 9/1974 | Muller | 33/143 R |
| 3,834,290 | 9/1974 | Nelson | 414/901 |
| 3,996,667 | 12/1976 | Barnard | 33/143 R |
| 4,189,133 | 2/1980 | Arrasmith et al. | 271/217 |
| 4,298,790 | 11/1981 | Decker et al. | 377/8 |

*Primary Examiner*—Gary Chin

*Attorney, Agent, or Firm*—Mason, Fenwick & Lawrence

[57] ABSTRACT

Apparatus for counting a number of sheet-like articles such as corrugated sheets of paper is disclosed as comprising a platen mounted to be driven rectilinearly from a topmost position to engage the top of the stack, a motor for reversibly driving the platen and a counter for counting the number of pulses required to drive the platen from its topmost position to the top of the stack, thus providing an indication by the number of counted pulses of the distance between the topmost platen position and the top of the stack. Further, a circuit is provided for determining the difference between the first measured distance and the total distance between the bottom of the stack to thereby provide an indication of the stack height, which stack height in a particular unit of measurement, e.g., inches, is multiplied by a factor corresponding to the number of sheets per unit measurement to provide the number of sheets in the stack.

8 Claims, 5 Drawing Figures

Fig-3-A
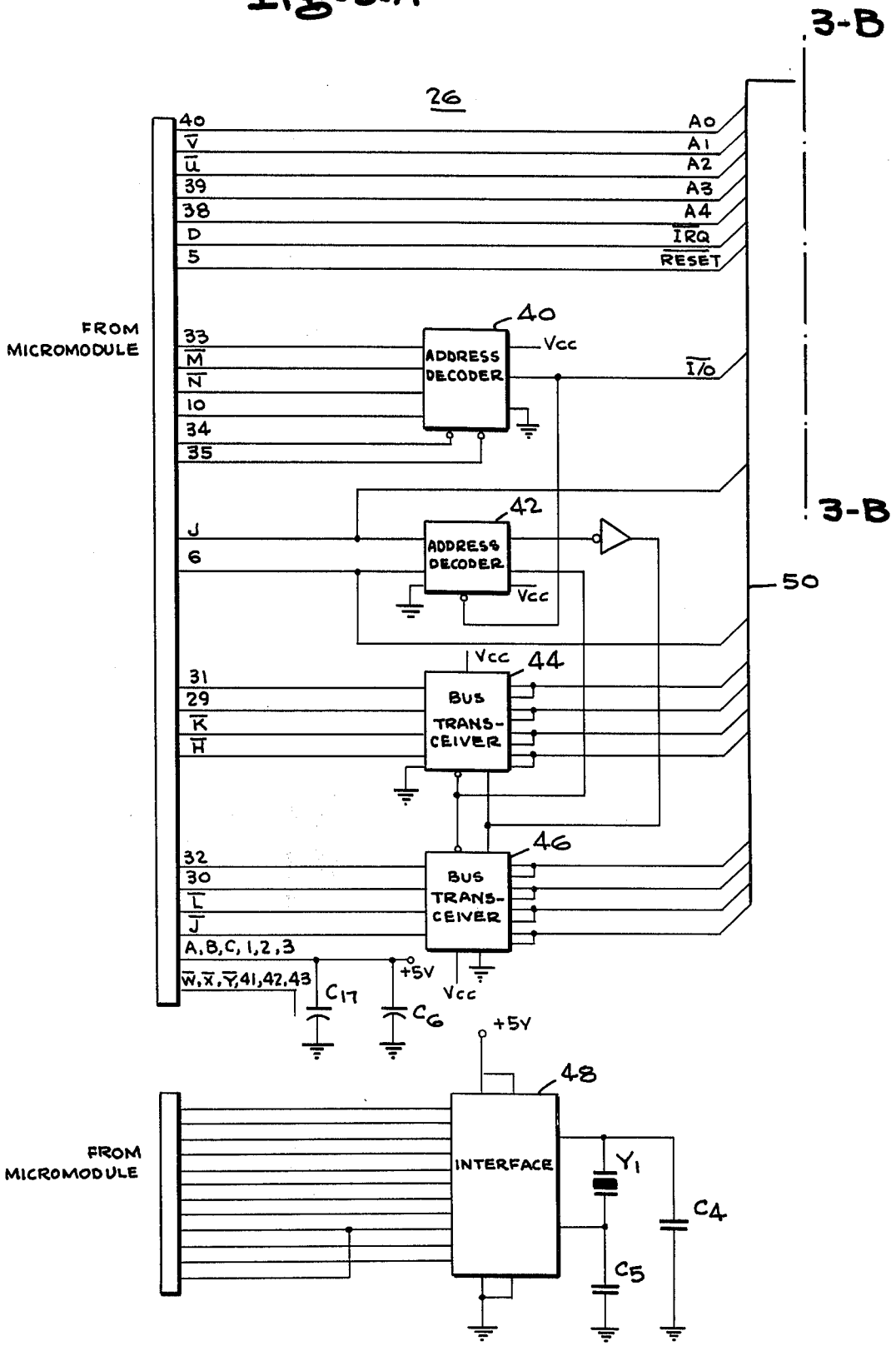

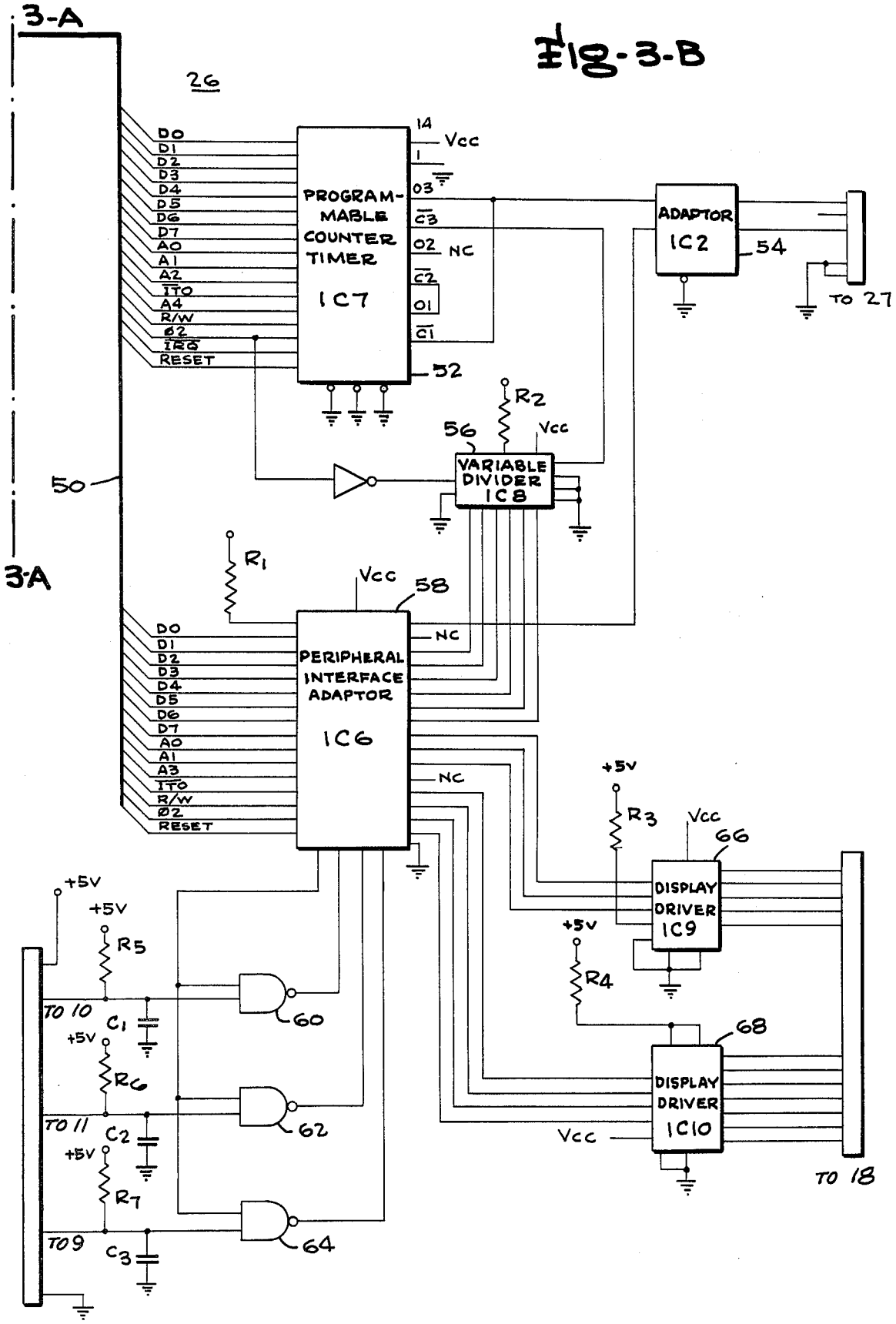
3-A
Fig-3-B
26
D0
D1
D2
D3
D4
D5
D6
D7
A0
A1
A2
ITO
A4
R/W
Ø2
IRQ
RESET
PROGRAM-MABLE COUNTER TIMER
IC7
14
Vcc
1
O3
C3
O2
NC
C2
O1
C1
52
ADAPTOR
IC2
54
TO 27
R2
56
Vcc
VARIABLE DIVIDER
IC8
50
3-A
R1
Vcc
58
PERIPHERAL INTERFACE ADAPTOR
IC6
NC
A3
+5V
R3
66
DISPLAY DRIVER
IC9
R4
68
DISPLAY DRIVER
IC10
TO 18
R5
TO 10
C1
60
R6
TO 11
C2
62
R7
TO 9
C3
64

STACKED ARTICLE COUNTING APPARATUS

BACKGROUND OF PRIOR ART

The present invention relates to apparatus for counting the number of stacked articles such as sheets of paper or related sheet materials and is more specifically directed to counting corrugated paper sheets.

Corrugated paper sheets are formed on conventional corrugating machines. Such sheets are sometimes deformed or buckled. Therefore, it is necessary that such a means of counting corrugated sheets be constructed in a manner to be able to apply sufficient pressure as to flatten out deformed sheets. Also, such an operation must be performed in a relatively short period of time as not to delay a high rate production line.

In the prior art, mechanical sheet counters are known for measuring the height of a stack and using that height to provide an indication of the number of sheets in the stack by dividing the stack height by a known sheet thickness. An example of such prior art is U.S. Pat. No. 3,298,605 of Bucke et al, which patent discloses an electro-mechanical device for counting the number of newspapers in a stack by indicating deviations from a normal stack number. The Bucke et al apparatus comprises a frame which straddles a newspaper conveyor carrying thereby a stack of newspapers. The frame supports a vertically rectilinearly movable ram for movement into contact with the top of the stack of newspapers. The ram carries a plurality of contact elements adapted to contact a corresponding set of stationary contact elements as mounted upon a plate. When a particular stationary contact is contacted by a ram contact, a corresponding light is energized indicating a specific ram height and a corresponding deviation from the normal number of newspapers. The height and number of newspapers in a normal stack are selectively varied by the switching mechanism.

The prior art stack counting apparatus is particularly adapted to count a single stack at a time and is not particularly adapted to effect the counting operation in an automatic fashion. In an aspect of the subject invention, it is desired to count not only the sheets of a single stack, but also to count the number of stacked articles as the stacks thereof are brought to the counting apparatus, keeping a running total of the sheets of the series of stacks. It is also desired to achieve a high degree of accuracy wherein an element in the form of a platen is moved and its movement is measured with a high degree of accuracy so that the stack height may be determined with a corresponding high degree of accuracy.

BRIEF SUMMARY OF THE INVENTION

It is an object of this invention to provide a new and improved apparatus for counting a stack of articles such as corrugated sheets of paper with increased accuracy.

It is a still further object of this invention to provide a new and improved stack sheet counting apparatus capable of measuring sheets of varying thickness.

It is a still further object of this invention to provide a new and improved stack sheet counting apparatus capable of successively measuring the number of sheets in successive stacks to give a summed indication of the number of sheets in a series of stacks.

In accordance with these and other objects of the invention, there is provided apparatus for counting a number of sheet-like articles such as corrugated sheets of paper, comprising a platen mounted to be driven rectilinearly from a topmost position to engage the top of the stack, a motor for reversibly driving the platen and a counter for counting the number of pulses required to drive the platen from its topmost position to the top of the stack, thus providing an indication by the number of counted pulses of the distance between the topmost platen position and the top of the stack. Further, means are provided for determining the difference between the first measured distance and the total distance between the bottom of the stack to thereby provide an indication of the stack height, which stack height in a particular unit of measurement, e.g., inches, is multiplied by a factor corresponding to the number of sheets per unit measurement to provide the number of sheets in the stack.

In a further feature of this invention, there is provided storage means for successively accumulating the numbers of sheets in each stack to thereby provide a total number indicative of the number of sheets conveyed past the apparatus of this invention.

In an illustrative embodiment of this invention, control means in the form of a microcomputer execute programs to effect the control of the platen in a rectilinear motion, of the initiating and terminating of the counting operation, and of the calculating of the number of sheets in a stack as well as to totalize the number of sheets in a series of stacks.

BRIEF DESCRIPTION OF THE DRAWINGS

A detailed description of a preferred embodiment of this invention is made in conjunction with the following drawings in which like reference numerals are used in the different figures for illustrating the same elements:

FIGS. 3A and 3B are detailed circuit diagrams of the computer implemented circuit as shown in FIG. 2A and more specifically shows the interface circuit elements for interconnecting the input thumbwheel switches and the limit switches to the microprocessor.

DETAILED DESCRIPTION OF INVENTION

Figure 1:
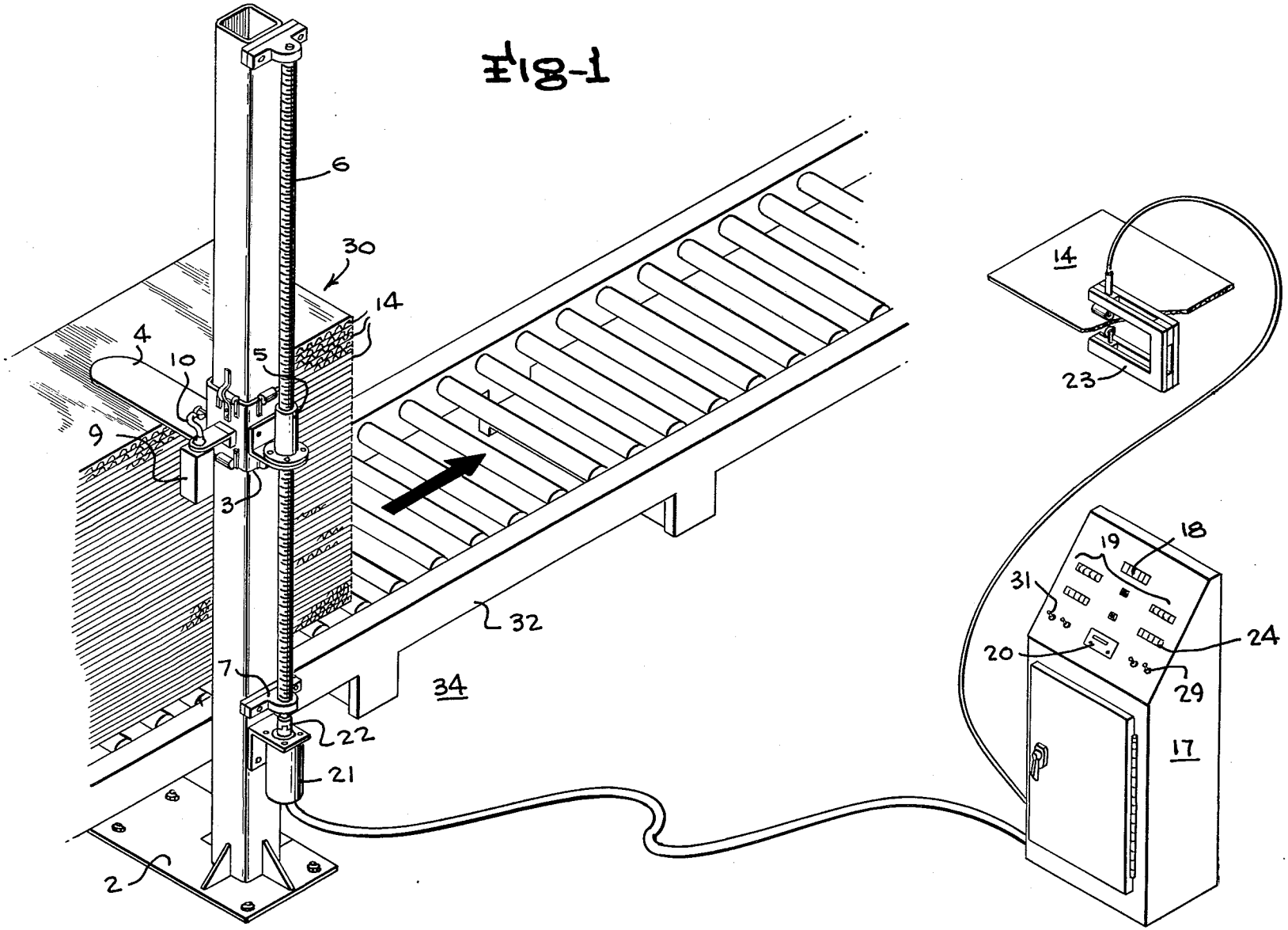
FIG. 1 is a perspective view of a rectilinearly driven platen, a drive motor and a conveyor for successively moving a series of stacks of sheet-like articles to a position beneath the platen in accordance with the teachings of this invention.

Referring now to the drawings and in particular to FIG. 1, there is shown apparatus in accordance with teachings of this invention for determining not only the number of sheets 14 within a single stack 30, but also the total number of sheets within a series of similar stacks 30. Each of a plurality of stacks 30 is brought to the measuring apparatus of this invention by a conveyor 32, the stacks 30 being moved in the direction shown by the arrow in FIG. 1. As illustrated, the conveyor 32 is mounted upon a floor 34. A base 2 of the sheet-measuring apparatus is also mounted on the floor 34 and includes a column 1 extending vertically from the base 2 for receiving a platen 4 by a hinge connected to a collar 3 disposed about the column 1 for rectilinear movement between a topmost position as defined by an upper limit switch 11 and a lower or stack top position as indicated by the top of the stack 30.

The platen 4 is driven rectilinearly by a stepping motor 21 that is mechanically coupled by a coupling 22 to a ball screw 6. The ball screw 6 is mounted along the axis of the column 1 by a set of pillar block bearings 7 disposed at either end of the ball screw 6 and fixedly secured to the column 1. A ball nut 5 engages the threads of the ball screw 6 to convert the rotational movement of the ball screw 6 into an appropriate rectilinear movement to drive the collar 3 and the platen 4 attached thereto. As will be described in detail, energizing signals in the form of a train of pulses are applied to the stepping motor 21 to effect a rotational output from the drive motor 21. In an illustrative embodiment, the drive motor 21 requires 200 such pulses to effect a signal revolution, and the pitch of the ball screw 6 is such that one revolution will drive the collar 3 and thus the platen 4 one-half inch; thus it can be seen that it is necessary to provide 400 pulses to the drive motor 21 to drive the platen 4 one inch. In addition, the drive motor 21 is reversible and a further signal is applied thereto to control whether the drive motor 21 rotates counterclockwise to effect the downward movement of the platen 4 or clockwise to effect an upward movement of the platen 4, as shown in FIG. 1.

As further shown in FIG. 1, there is included a main console 17 including a control circuit as will be described in detail with regard to FIGS. 2A and 3 for controlling the movement of the platen 4, as well as to provide a digital-type display of the number of sheets within a stack 30 or a series of stacks 30 upon a readout display 18. In addition, the main console 17 also mounts a set of thumbwheel switches 19, whereby the number of sheets 14 per inch may be entered, as well as other parameters including the height of the topmost surface of the conveyor 32 above the floor 34, the customer order number, the number of stacks 30 passing the counter apparatus at one time, and the initial time and date. In addition, the main console 17 includes a panel printer 20 to provide a printed record of the order number, date, total number of stacks 30 and the total number of sheets 14.

Figure 2A:
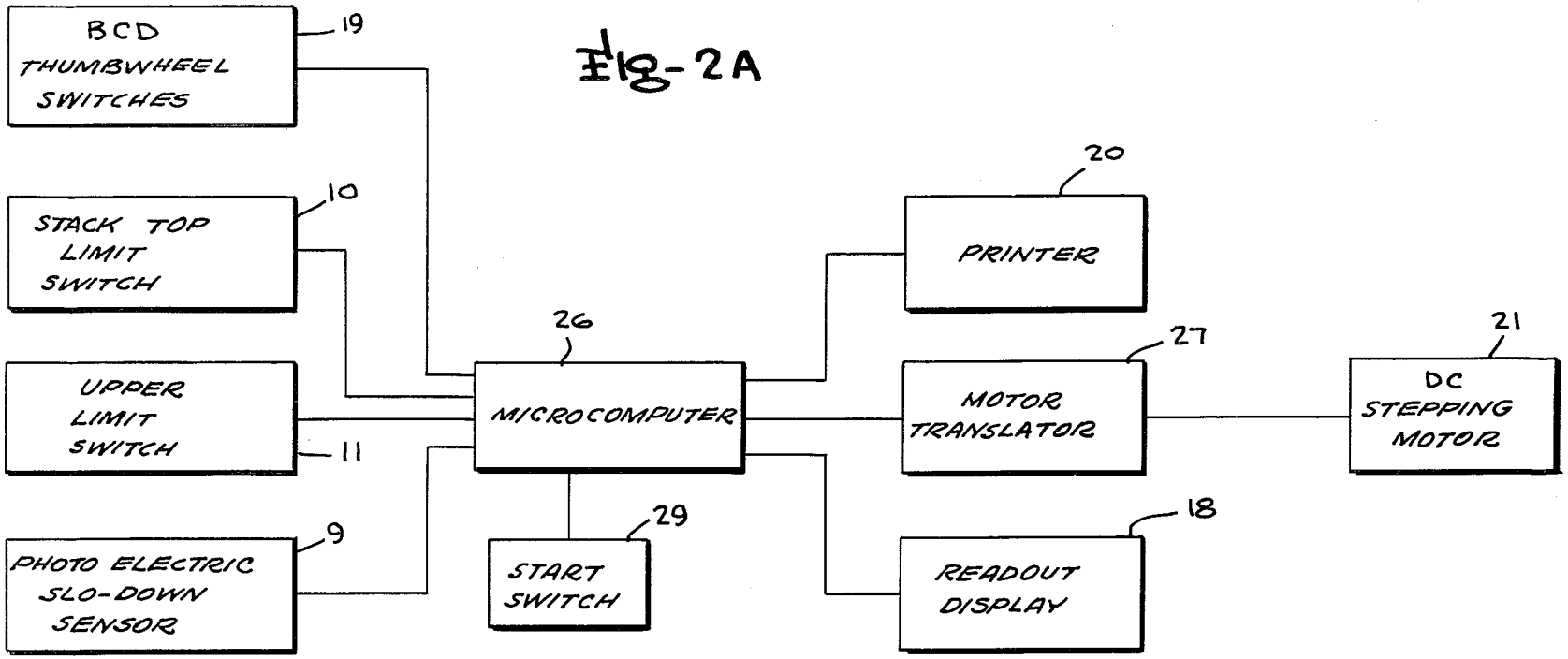
FIGS. 2A and 2B are functional block diagrams respectively of a microcomputer implemented control system for controlling the movement of the platen showed in FIG. 1, as well as to effect the counting operation whereby the stack height and the number of sheets in a stack are determined, and of a mechanism for measuring the thickness of the sheet-like articles.
Figure 2B:
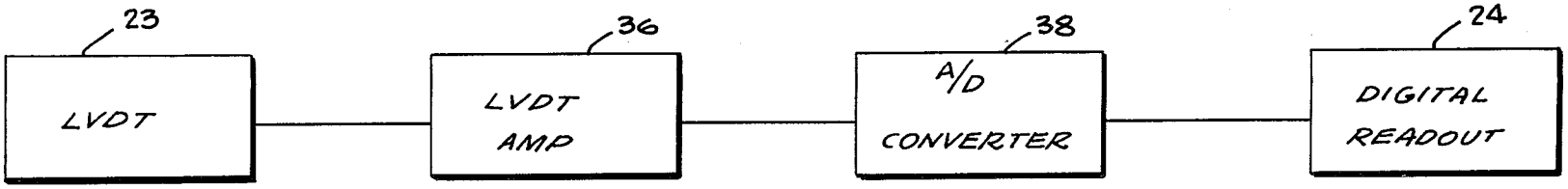

Referring now to FIGS. 1 and 2B, there is shown a mechanism for measuring the thickness of a sheet 14, the thickness to be entered by the thumbwheel switches 19 into the control circuit. In particular, there is shown a linear variable differential transducer 23 for receiving a sheet 14 to provide an analog output signal indicative of its thickness. An amplifier 36 amplifies the transducer output signals and applies its output to an A/D converter 38 to provide a digital output to the readout display 24, whereby a visual indication of the thickness of the sheet 14 is provided and the operator may enter that displayed thickness indication via the thumbwheel switches 19 into the control circuit.

Referring now to FIG. 2A, there is shown a high-level functional block diagram of the control circuit for not only controlling the rectilinear movement of the platen 4, but also for effecting a measurement of the platen travel distance and from that measurement, a computation of the thickness of a sheet 14. The central element of the control system is a microcomputer 26 that executes a program, as will be explained in detail, as stored within an internal memory. The thumbwheel switches 19, the stack top limit switch 10, the upper limit switch 11 and the photoelectric slowdown sensor 9, as well as start switch 29 are coupled to the microcomputer 26. Suitable outputs are provided from the microcomputer 26 to drive the printer 20 and the readout display 18. As will be explained in some detail, the microcomputer 26 applies a train of drive pulses to a motor translator 27 whereby the direction and speed of the DC stepping motor 21 may be controlled.

In operation, the corrugated sheets 14 are cut and then stacked on the conveyor 32 to be brought to a position beneath the platen 4. When the sheets are disposed directly beneath the platen 4, the operator initiates the measuring process by pushing the start switch 29, whereby a train of drive pulses are applied to the stepping motor 21 rotating the ball screw 6 in a counterclockwise direction whereby the collar 3 and thus the platen 4 are driven downwardly. Almost immediately, the collar 3 actuates the upper limit switch 11 to initiate a counting operation. As will be explained in greater detail later, the same pulses that are applied to drive the stepping motor 21, are also applied to a counter within the internal memory of the microcomputer 26 which is actuated to initiate the counting upon the opening of the upper switch 11, the counting process being terminated when the platen 4 contacts the top of the stack 30, thereby closing the stack top limit switch 10. As seen in FIG. 2A, each of the upper limit switches 11 and the stack limit switch 10 are coupled to the microcomputer 26 to effect respectively the initation and termination of the counting operation. In the particular illustrative embodiment of this invention, it requires 400 pulses to drive the platen 4 through a unit measurement and in particular one inch. Thus by counting the number of pulses until the stack top limit switch 10 is closed, the distance between the top of the stack 30 and the initial starting position at the top of column 1 may be determined; this distance is in turn subtracted, as will be explained in detail, from the known distance between the top suface of the conveyor 32 and the position of the upper limit switch 11. This difference corresponding to the height of the stack 30 is multiplied times a factor indicative of the number of sheets 14 per unit measurement (inch) to obtain the total number of sheets 14 within a stack 30. It is contemplated that a series of stacks 30 may be successively brought to the apparatus shown in FIG. 1, the number of sheets 14 within each such stack 30 measured and stored within the memory of the microcomputer 26 to provide a total number of sheets 14 within the series of stacks 30 corresponding to a customer order. As explained above, the thickness of a particular sheet 14 is measured by the transducer 23 and that thickness or more specifically the number of sheets per unit measured is entered via the thumbwheel switches 19. In addition, a slowdown sensor 9 is mounted also on the collar 3 to intercept first the top of the stack 30 before the top of the stack 30 contacts the platen 4 to actuate the stack top limit switch 10. The output of the slowdown sensor 9 is applied to the microcomputer 26 to effect a slowdown or deceleration of the platen movement. After the platen 4 has made contact with the top of the stack 30 and a determination of the number of sheets 14 within the stack 30 has been made, the microcomputer 26 applies appropriate signals via the motor translator 27 to the DC stepping motor 21, whereby the platen 4 is returned to its initial position at the top of the column 1. In addition, the microcomputer 26 actuates the readout display 18 to provide an indication of the number of sheets 14 and to actuate the printer 20 to provide a manifestation of the order number, date, total number of stacks and total number of sheets 14.

Referring now to FIGS. 3A and B, there is shown a detailed circuit diagram of the microcomputer 26 (generally shown in FIG. 2A) including interface circuitry for interconnecting the microcomputer 26 to the various switches, sensors and the motor translator 27, as more generally described above. The microcomputer includes a Micromodule, not shown in FIGS. 3A and B, taking the form of the Micromodule as manufactured by Motorola under their designation 1A/1A2. As is well known in the art, such a Micromodule includes a micorprocessor MC6800P MPU, a ROM, a RAM, at least one peripheral interface adapter, an internal clock and a serial interface adapter. The Micromodule is connected via the input connectors shown in FIG. 3A to a pair of address decoders 40 and 42 each illustratively taking the form of circuits manufactured by Texas Instruments under their designation SN74LS138N and a pair of bus transceivers 44 and 46 manufactured by Signetics under their designation 8T26A to a bus 50. The bus 50 is connected as illustrated to a programmable counter timer 52 illustratively taking the form of that circuit manufactured by Motorola under their designation MC6840P and to a peripheral interface adapter 58 manufactured by Motorola under their designation MC6821P. A clock signal is provided by an interface circuit 40*a* to the microcomputer 26 and is driven by the shown crystal. The peripheral interface adapter 58 interconnects the stack top switch 10, the upper limit switch 11 and the slowdown sensor 9 via a set of NAND gates 60, 62 and 64, respectively, to the microcomputer 26. The peripheral interface adapter 58 is capable of applying input signals from the aforementioned switches to the microcomputer 26, as well as to apply signals from the microcomputer 26 via a display driver 68 as manufactured by Motorola under their designation MC14511BCP and a display driver 66 as manufactured by Signetics under their designation NE590N, respectively, to the readout display 18.

The programmable counter timer 52 comprises three distinct counters, the first counter for generating an interrupt clock signal to be applied to the microcomputer 26 to effect a look at each of the above-described switches, a second counter for providing as an output a train of pulses to be applied via an adapter 54 to the motor translator 27 to effect the drive of the DC stepping motor 21, and a third counter for counting the drive pulses to effect a measurement of the distance to the top of the stack 30. In addition, a system clock as applied upon line $\phi 2$ of bus 50 is applied to a variable divider 56 manufactured by Texas Instruments under their designation SN7497N to variably divide the systems clock signal before being applied to the C3 terminal of the programmable counter timer 52. The factor by which the system clock signal is divided is entered as a digital number into the variable divider 56 from the peripheral interface adapter 58. In this manner, a slowdown or deceleration of the stepping motor 21 may be effected by reducing the rate of the drive pulses applied to the motor translator 27. In addition, output 17 of the peripheral interface adapter 58 is applied via the adapter 54 to the motor translator 27 to effect whether the DC stepping motor 21 is driven in a counterclockwise direction, thus directing the platen 4 downward, or in a clockwise direction to drive the platen 4 upward.

In an illustrative embodiment of this invention, the motor translator 27 takes the form of that translator manufactured by the Superior Electric Company under their designation TBM105-9322 to be used with the DC stepping motor taking the form of a motor manufactured by the same company having a designation M093-FD301.

The microcomputer 26 has an internal memory that is programmed with a set of instructions to effect the above-described operations, as will now be explained in greater detail.

In an illustrative embodiment of this invention, the program is written in a proprietary language known as "MICROFORTH", a trademark of Forth, Inc. An illustrative example of the particular program in the noted language is set out below as a series of screens 53 through 61:

53

```
0 ( VARIABLES) HEX 53 .CR
1
2 0 CVARIABLE 1FLAG    0 CVARIABLE 2FLAG    0 CVARIABLE 3FLAG
3 0 CVARIABLE DPTR                                              LF
4
5 0 VARIABLE T-UNITS   0 VARIABLE CUST      0 VARIABLE HLD
```

```
 6 0 VARIABLE CAL                                                    LF
 7
 8 0 VARIABLE TIME 0B RES          0 VARIABLE BUFF 5 RES
 9 0 VARIABLE TOTAL 2 RES          0 VARIABLE DISBUF 4 RES
 A 0 VARIABLE #SHEETS 2 RES
 B ;S
 C
 D
 E
 F
54

 0 ( 32 BIT MATH 1) HEX 54 .CR
 1 CODE E*   10 # B LDA   N 1+ B STA   A CLR   B CLR
 2    TSX   2 ) LSR   3 ) ROR
 3    BEGIN   CS IF   1 ) B ADD   0 ) A ADC
 4            THEN   A LSR   B ROR   2 ) ROR   3 ) ROR
 5    N 1+ DEC   0= END   PUT JMP
 6
 7 CODE E/   A PUL   B PUL   N A STA   N 1+ B STA
 8    10 # B LDA   N 2+ B STA   TSX   3 ) ASL   2 ) ROL
 9    BEGIN   1 ) ROL   0 ) ROL   1 ) B LDA   0 ) A LDA
 A       N 1+ B SUB   N A SBC   CS NOT IF   1 ) B STA   0 ) A STA
 B       THEN   3 ) ROL   2 ) ROL   N 2+ DEC   0= END
 C    3 ) COM   2 ) COM   NEXT JMP
 D
 E : /   0 SWAP E/ DROP ;   : *   E* DROP ;
 F : 2DUP   OVER OVER ;   : D0=   0= SWAP 0= AND ;
55

 0 ( 32 BIT MATH 2) HEX 55 .CR
 1
 2 CODE D+   TSX   3 ) B LDA   7 ) B ADD   7 ) B STA
 3    2 ) B LDA   6 ) B ADC   6 ) B STA   A PUL B PUL
 4    5 ) B ADC   5 ) B STA   4 ) A ADC   4 ) A STA   POP JMP
 5
 6 CODE 2@   TSX   0 ) LDX   INS INS   3 ) B LDA   2 ) A LDA
 7    B PSH   A PSH   1 ) B LDA   0 ) A LDA   PUSH JMP
 8
 9 CODE 2!   TSX   0 ) LDX   INS INS   A PUL   B PUL   0 ) A STA
 A    1 ) B STA   A PUL   B PUL   2 ) A STA   3 ) B STA   NEXT JMP
 B
 C : M*/   <R   DUP <R   ROT E*   ROT 0 SWAP   R> E*   D+
 D    I E/   ROT SWAP R>   E/   DROP SWAP ;
 E
 F : M/MOD   <R 0 I E/ <R SWAP R> R> E/ <R SWAP R> ;

56

 0 ( PRINTER CONTROL) HEX 56 .CR
 1
 2 : POUT   BEGIN 8408 C@ 2 AND END 8409 C! ;
 3 : PRINT   0 DO DUP C@ POUT 1+ LOOP DROP ;
 4 : SPACES   0 DO 20 POUT LOOP ;
 5 : CR   0D POUT ACD BEGIN 1 - DUP 0= END DROP ;
 6 : COUNT   DUP 1+ SWAP C@ ;
 7 : #OUT   30 + POUT ;
```

```
8 : 2OUT   TIME + DUP C@ #OUT 1 - C@ #OUT ;
9
A
B
C
D
E
F
```

57

```
0 ( STRINGS) HEX 57 .CR
1
2 H: STRING   <BUILDS
3    22 WORD FORTH HERE DUP C@ DUP HOST C, OVER + 1+ SWAP 1+
4    DO FORTH I C@ HOST C, LOOP DOES>
5    COUNT PRINT ;
6
7 STRING 'ORDER#' ORDER NUMBER"
8 STRING 'DATE' DATE"
9 STRING 'T-U-C' TIME      UNIT COUNT"
A STRING '---' --------------------"
B STRING 'T-UNITS' TOTAL UNITS"                                    LF
C STRING 'TOTAL' TOTAL SHEETS"
D STRING 'AM'   AM "
E STRING 'PM'   PM "
F
```

58

```
0 ( NUMBER CONVERSION) HEX 58 .CR
1
2 : PAD   BUFF 7 + ;     : HOLD   HLD @ 1 - DUP HLD ! C! ;
3 : <#    PAD HLD ! ;    : #   0A M/MOD 30 + HOLD ;
4 : #S    BEGIN  #  2DUP D0= END ;
5 : #>    DROP DROP   HLD @   PAD OVER - ;
6 : .2R   <R <# #S #> R> OVER - SPACES PRINT CR ;
7 : .R    0 SWAP .2R ;
8
9
A
B
C
D
E
F
```

59

```
0 ( CODE DEFINITIONS) HEX 59 .CR
1 ASSEMBLER   BEGIN
2    8011 A LDA   8014 LDX   01 # A LDA   1FLAG A STA
3    DUP FFFC ! FFF8 INTERRUPT
4
5 CODE GETSW   8406 A LDA   F0 # A ORA   8406 A STA
6    A PUL B PUL   8402 A STA   8400 B STA   8400 B LDA
7    B COM   0F # B AND   A CLR   PUSH JMP
```

```
8 CODE GETOFF    A PUL B PUL   8406 B STA   8400 B LDA
9    B COM   0F # B AND   A CLR   PUSH JMP
A CODE PULSE   TSX   0 ) LDX   3C # A LDA   0 ) A STA
B    34 # A LDA   0 ) A STA   POP JMP
C CODE LIMIT   8000 # LDX   08 ) A LDA   0A ) A LDA
D    3C # A LDA   0B ) A STA   34 # A LDA   0B ) A STA
E    A PUL B PUL   09 ) B AND   0B ) A AND   ABA
F    0= IF   B INC   ELSE   B CLR   THEN   A CLR   PUSH JMP
5A

0 ( SWITCH INPUT) HEX 5A .CR
1 : OFFSET   FFF0 GETSW DROP   70 GETOFF A0 *
2    B0 GETOFF 10 * +   D0 GETOFF 0A * +   E0 GETOFF + 19 * ;
3
4 : 'T/D'   FFE0 GETSW 04 AND ;   : 'STOP'   FFE0 GETSW 02 AND ;
5 : 'GO'   FFE0 GETSW 01 AND ;
6 : 'TOP'   80 LIMIT ;   : 'STACK'   8000 LIMIT ;
7 : 'BOT'   40 LIMIT ;
8 : ?TOP   2FLAG C@ IF 'TOP' NOT IF
9    FFFF 8012 M! 0 2FLAG C! THEN THEN ;
A
B CODE RIGHT   A PUL B PUL   A ASR B ROR   80 # A ORA   PUSH JMP
C
D : GET   0 5 0 DO 0A * OVER GETSW + SWAP RIGHT SWAP LOOP
E    SWAP DROP ;
F : ?CUST   7FF0 GET CUST ! ;
5B

0 ( CALENDAR) HEX 5B .CR
1 : TPUT   80 + 8404 C! 8406 C! 8407 PULSE ;
2 : STIME   OVER OVER GETSW TPUT DUP + 10 + GETSW ROT +
3    SWAP 1+ SWAP TPUT ;
4
5 : FREEZE   80 8404 C! ;   : MELT   34 8405 C! 0 8404 C! ;
6 : CALENDAR   30 8405 C! FF 8404 C! 34 8405 C! FREEZE
7    F7F0 GETSW 0A * FFD0 GETSW + DUP 4 / 4 * = IF 4 ELSE 0 THEN
8    09 BFF0 STIME   00 07 EFF0 STIME
9    0C F7F0 GETSW TPUT   0B FFD0 GETSW TPUT
A    FBF0 GETSW 04 * 04 FEF0 STIME
B    00 02 FFB0 STIME   1 0 TPUT   0 0 TPUT
C    30 8405 C! 80 8404 C! MELT ;
D
E : ?TIME   FREEZE 3C 8405 C! TIME 0D 0 DO
F    I 8406 C! 8404 C@ 0F AND OVER C! 1+ LOOP DROP MELT ;

5C

0 ( PRINTER) HEX 5C .CR
1
2 : HEAD   CR 'ORDER#' 3 SPACES 7FF0
3       5 0 DO DUP GETSW #OUT RIGHT LOOP DROP CR
4    'DATE' 8 SPACES ?TIME
5       0A 2OUT 2F POUT 08 2OUT 2F POUT 0C 2OUT CR
6    'T-U-C' CR   '---' CR ;
7
8 : 1LINE   ?TIME TIME 05 + DUP C@ <R I 03 AND #OUT
```

```
9     1 - C@ #OUT 3A POUT 03 2OUT R> 04 / DUP
A     0= IF 'AM' DROP ELSE 1 = IF 'PM' ELSE 4 SPACES THEN THEN
B      #SHEETS 2@ 0B .2R ;
C
D : SUMMARY    '---' CR 'T-UNITS' T-UNITS @ 9 .R
E     'TOTAL' TOTAL 2@ 8 .2R CR CR CR
F     0 0 TOTAL 2! 0 T-UNITS ! ;
5D

0 ( DISLAY) HEX 5D .CR
1
2 : DOFF    FF 8008 C! ;
3 : BLANK    DISBUF 6 + DISBUF DO 0F I C! LOOP DOFF ;
4 : .DISP    BLANK DISBUF 6 + HLD ! #S DROP DROP ;
5
6 : NEWCUST     BLANK TOTAL 2@ D0= NOT IF SUMMARY 1 3FLAG C! THEN
7
8 CODE DISPLAY    DPTR B LDA    B INC    07 # B CMP
9        0= IF    B CLR    THEN    DPTR B STA
A     A CLR    5 # B LDA    DPTR B SUB    0 # A SBC
B     DISBUF # LDX    N STX    N 1+ B ADD    N A ADC
C        N A STA    N 1+ B STA    N LDX
D     0 ) B LDA    0F # B AND
E     DPTR A LDA    A ASL A ASL A ASL A ASL A ASL
F     ABA    8008 A STA    NEXT JMP

5E

0 ( MOTOR CONTROL) 5E .CR
1 : SLOW    1F3F 8014 M! ;    : FAST    07CF 8014 M! ;
2 : CW    80 800A C! ;    : CCW    00 800A C! ;
3
4 : ACCEL    0 1FLAG C! 800A C@ 1+ DUP 800A C! 3F AND 3F = + ;
5 : DACCEL    0 1FLAG C! 1 2FLAG C! CCW
6     BEGIN ?TOP 'BOT' 'STOP' + 1FLAG C@ IF ACCEL THEN END ;
7 : DRUN    BEGIN ?TOP 'BOT' 'STOP' + 'STACK' + END ;
8 : DDECEL    BEGIN 'STOP' 'STACK' + 1FLAG C@ IF 0 1FLAG C!
9     800A C@ 1 - DUP 3F AND 0E < IF DROP ELSE 800A C! THEN THEN
A     END CW ;                                                    LF
B : UACCEL    CW SLOW BEGIN 'TOP' 'STOP' + 1FLAG C@ IF ACCEL THEN
C     END FAST ;
D : URUN    BEGIN 'TOP' 'STOP' + 1FLAG C@ IF DISPLAY
E     THEN END ;
F : UP    BLANK UACCEL URUN CCW ;

5F

0 ( MEASURE) HEX 5F .CR
1
2 : COMPUTE    FFD0 GETSW
3     8012 @ 1+ MINUS CUST @ IF
4        OFFSET -DUP IF 8692 SWAP - ELSE CAL @ THEN SWAP - 0
5        FBF0 GET 4E20 M*/ 1 0  D+ 2 E/ DROP E*
6        2DUP #SHEETS 2! 2DUP .DISP TOTAL 2@ D+ TOTAL 2!
7        1 T-UNITS +!
8     ELSE CAL ! 0 0 #SHEETS 2! DROP THEN ;
9
```

```
A : MEASURE   SLOW BLANK DACCEL DRUN DDECEL FAST
B    'STOP' NOT IF COMPUTE ELSE 0 0 #SHEETS 2! THEN
C    UACCEL URUN CCW ;
D ;S
E
F
```

60

```
0 ( INITIALIZATION) HEX 60 .CR
1
2 CODE SETI/O
3    8009 CLR   FF16 # LDX   8008 STX   FF # A LDA   8008 A STA
4    800B CLR   FF36 # LDX   800A STX   800A CLR
5    07CF # LDX   8014 STX   0025 # LDX   8016 STX   8011 CLR
6    81 # A LDA   8010 A STA   53 # A LDA   8011 A STA
7    A0 # A LDA   8010 A STA
8    8401 CLR   F004 # LDX   8400 STX
9    8403 CLR   FF04 # LDX   8402 STX
A    8405 CLR   8034 # LDX   8404 STX   8404 CLR
B    8407 CLR   FF34 # LDX   8406 STX
C    03 # A LDA   8408 A STA   15 # A LDA   8408 A STA
D    CLI   NEXT JMP
E : INIT   0 0 TOTAL 2! 0 T-UNITS ! 0 1FLAG C! 1 3FLAG C!
F    0 DPTR C! ?CUST BLANK ;
```

61

```
0 ( MAINLINE CODE - SHEET COUNTER) HEX 61 .CR
1
2 : S/C   SETI/O INIT BEGIN
3    'T/D' IF CALENDAR THEN
4    'GO' IF 'TOP' IF MEASURE #SHEETS 2@ DO= NOT DUP
5       3FLAG C@ AND IF DOFF HEAD 0 3FLAG C! THEN
6       IF DOFF 1LINE THEN
7       ELSE UP THEN THEN
8    DPTR C@ 6 = IF CUST @ ?CUST CUST @ - IF NEWCUST THEN THEN
9    1FLAG C@ IF DISPLAY THEN
A 0 END ;
B ;S
C
D
E
F
```

A high order of summary of the above program is given in screen 5F wherein at line A, the DACCEL is called to effect an acceleration of the motor drive instruction to direct the platen 4 in a downward direction and thereafter, the program calls DRUN to continue to drive the motor translator 27 and therefor the DC stepping motor 21 at full speed until an output from the slowdown sensor 9 is received, at which time the DDECEL is called to effect a deceleration of the motor 21. As illustrated at line B of screen 5F, the process takes a look to see whether the stopbutton 31 (see FIG. 1) has been pushed and if not, the COMPUTE subroutine is called. If the stopbutton 31 has been pushed, the counting operation that has been effected is disregarded and a zero is displayed as the number of sheets counted. In line C, the UACCEL subroutine is called to effect an acceleration of the motor drive in an upward direction, until the URUN subroutine is called to drive the motor 21 at full speed in the upward direction. The platen 4 is driven upward until the upper limit switch 11 is closed, at which time the motor 21 is stopped.

The COMPUTE subroutine is illustrated in greater detail at line 2 of screen 5F, wherein the instruction GETSW calls for data identifying the number of stacks within a particular customer's order. At line 3, the number of counts as counted by the programmable counter timer 52 is obtained. At line 4, data is entered into the program in the form of a number 8692 indicative of the distance as the number of pulses required to drive the platen 4 from the top to the floor. The OFFSET data indicating the distance from the floor to the top of the conveyor 32 is subtracted from that number to provide an indication of the distance between the top of the conveyor 32 and the position of the platen 4 when switch 11 is opened. At line 5, the program obtains that factor FDFO as entered via the thumbwheel switch 19 indicative of the number of sheets per unit measurement, and multiplies this factor times the count indicative of the stack height as obtained at line 3, to obtain an indication of the number of sheets in a particular stack; this count or number is further multiplied by the number of stacks that are brought to the measuring apparatus, to obtain a total number of sheets within a customer's order. As can be recognized by one skilled in the art, the particular details of the afore-described subroutines are set out in the remaining screens of the program. Thus there has been described apparatus for measuring automatically and with high accuracy the number of sheets within a stack, wherein the thickness of the sheet may vary and may be selectively entered. In addition, the apparatus as described above is capable of measuring the number of sheets in a succession of similar stacks.

In considering this invention, it should be remembered that the present disclosure is illustrative only and the scope of the invention should be determined by the appended claims.

We claim:

1. Apparatus for determining the height of a stack of sheet-like elements, said apparatus comprising:

(a) platen means movably suspended to sense the top of the stack for providing a terminating signal upon the sensing thereof;

(b) means for providing a train of regular pulses;

(c) drive means responsive to the regular pulses for driving said platen means from an initial position toward the stack; and (d) counter means responsive to the movement of said platen means from said initial position for initiating the counting of the regular pulses, and responsive to the terminating signal for terminating the counting of the pulses, the number of pulses counted by said counter means being indicative of the height of the stack, whereby the number of sheet-like elements can be determined by said height of the stack.

2. Apparatus as claimed in claim 1, wherein there is included computation means coupled to said counter means for providing a stack height manifestation indicative of the difference between the distance between the bottom of the stack and said initial position, and the distance from the top of the stack to the initial position as indicated by the counted number as derived from said counter means.

3. The apparatus as claimed in claim 2, wherein said computation means comprises means for multiplying a factor indicative of the number of sheet-like elements per unit measurement times the stack height manifestation to provide an output manifestation indicative of the number of sheet-like elements within a stack.

4. The apparatus as claimed in claim 1, wherein there is included switch means disposed to sense the movement of said platen means from said initial position for providing an initating signal, said counter means being responsive to said initiating signal for initiating the counting of the regular pulses.

5. The apparatus as claimed in claim 1, wherein said platen means comprises stack top switch means and a platen member disposed to engage the top of the stack for actuating said switch means to provide the terminating signal.

6. The apparatus as claimed in claim 5, wherein said drive means comprises a stepping motor responsive to each of the regular pulses for effecting a discrete rotational output, a screw coupled with said platen means for effecting movement thereof in response to the rotation of said stepping motor.

7. The apparatus as claimed in claim 3, wherein there is included conveyor means for serially conveying to a position beneath said platen means a series of the stacks of the sheet-like elements.

8. Apparatus as claimed in claim 7, wherein said multiplying means multiplies a factor indicative of the number of stacks time the previously calculated output manifestation.

* * * * *